US005981929A

United States Patent [19]

Maeda et al.

[11] Patent Number: 5,981,929

[45] Date of Patent: Nov. 9, 1999

[54] HEATING COOKER WITH A SPACE-EFFICIENT VENTILATING ARRANGEMENT

[75] Inventors: Kazunori Maeda; Satoru Kodama; Hisahiro Nishitani, all of Nara, Japan

[73] Assignee: Matsushita Electric Industrial Co., Ltd., Osaka, Japan

[21] Appl. No.: 09/052,943

[22] Filed: Apr. 1, 1998

[30] Foreign Application Priority Data

| | | | |
|---|---|---|---|
| Dec. 20, 1996 | [JP] | Japan | 8-341027 |
| Apr. 1, 1997 | [JP] | Japan | 9-082591 |
| Nov. 19, 1997 | [JP] | Japan | 9-317937 |
| Dec. 3, 1997 | [JP] | Japan | 9-332623 |

[51] Int. Cl.[6] ..... H05B 6/64

[52] U.S. Cl. ..... 219/757; 126/299 D

[58] Field of Search ..... 219/756, 757, 219/400; 126/299 D, 299 R, 400

[56] References Cited

U.S. PATENT DOCUMENTS

| | | | |
|---|---|---|---|
| 3,818,171 | 6/1974 | Miller et al. | 219/757 |
| 4,313,043 | 1/1982 | White et al. | 219/756 |
| 4,327,274 | 4/1982 | White et al. | 219/756 |
| 4,369,347 | 1/1983 | Shin | 219/757 |
| 4,786,774 | 11/1988 | Kaminaka . | |
| 4,886,046 | 12/1989 | Welch . | |

*Primary Examiner*—Teresa Walberg
*Assistant Examiner*—Jeffrey Pwu
*Attorney, Agent, or Firm*—Wenderoth, Lind & Ponack, L.L.P.

[57] ABSTRACT

The present invention relates to heating cookers, particularly to a structure for ventilation and cooling of microwave ovens employing a range hood. The structure according to the present invention enhances the ventilation airflow and capacity of a heating chamber by enlarging diameter of a ventilating fan by forming a recess on an upper wall of the heating chamber and by disposing the ventilating fan in the recess. Also, an improvement in ventilation efficiency is achieved by disposing the ventilating fan of a larger diameter at either or both ends of a wave-guide, and dividing the airflow path into an evenly well balanced plurality of airflow paths. Moreover, an openable door is attached to either or both of an exhaust opening and an intake opening for the air to pass through an inner surface of the door, thereby keeping the soiled surface inconspicuous. Furthermore, a cooling fan for a machinery compartment is disposed on an upper part of the machinery compartment in order to widen the airflow path for further improvement of the cooling and ventilation efficiency.

37 Claims, 13 Drawing Sheets

HEATING COOKER WITH A SPACE-EFFICIENT VENTILATING ARRANGEMENT

FIELD OF THE INVENTION

The present invention relates to heating cookers and, particularly, to microwave ovens employing a range hood. More specifically, the invention relates to the structure for a ventilating fan and a cooling fan for cooling off a machinery compartment.

BACKGROUND OF THE INVENTION

As a conventional heating cooker employing a range hood, an apparatus body 501 having a function of range hood is mounted on a kitchen wall 502, as shown in FIG. 11 through FIG. 13. That is, the apparatus body is placed in a very tight and restricted space where it is surrounded by a ceiling (not shown) above, another heating cooker 503 underneath, and for example storage cabinets 504 on both sides. The conventional structure is described below by referring to the drawings.

The apparatus body 501 comprises three sections, namely: a range hood section having a ventilating fan 505 and others; a heating section having a heating chamber 506 wherein food is placed and heated; and a cooling section having a cooling fan 509 and others provided to maintain a high frequency generating apparatus 507 such as a magnetron tube for heating and cooking the food and a control device 508 at temperature below a predetermined level.

It is therefore desirable to equip the apparatus body 501 with a ventilating fan having a large volume of exhausting air with a low noise, a heating chamber of a large capacity capable of heating and cooking a large mass of food, and a compact and efficient cooling means. On the other hand, a pace available for installation of the apparatus body 501 in kitchen is limited, thereby restricting external dimensions of the apparatus body 501, resulting in certain problems as described below.

First, the range hood section is described. In the prior art, heating cookers of this kind are provided with, over the heating chamber 506 wherein food is placed, a wave-guide 510 which transmits high frequency energy generated by the high frequency generating apparatus 507, and a feeding port 511 on a top wall of the heating chamber 506 to supply the high frequency energy into the heating chamber 506. On the other hand, the apparatus body 501 has intake openings 512*a* and 512*b* of the apparatus body on its bottom wall to draw air containing gaseous product generated by the second heating cooker 503 such as a gas cooking stove, and the drawn air is exhausted outside by the ventilating fan 505 located above the heating chamber 506 through an exhaust opening 513 of the apparatus body and an attached air duct. The ventilating fan 505 has intake openings 514*a* and 514*b* of the ventilating fan at its suction side and an exhaust opening 515 of the ventilating fan at its venting side. The heating chamber 506 is approximately symmetrical in its shape and has the feeding port 511 in approximate center of the upper wall of the heating chamber 506, in order to obtain an even distribution of the high frequency energy on both sides within the heating chamber 506 for heating the food uniformly. Also, as a general practice the exhaust opening 513 of the apparatus body is located in the upper rear corner of the apparatus body 501, because a direction of the exhaust air-flow may vary between rearward and upward depending upon an installation of the apparatus body 501. It is also the general practice that the ventilating fan 505 is positioned adjacent to the exhaust opening 513 of the apparatus body, in the upper rear corner of the apparatus body 501, as described in U.S. Pat. No. 4,786,774, so as to minimize an air-flow resistance from the exhaust opening 515 of the ventilating fan to the exhaust opening 513 of the apparatus body and to assure an efficient exhausting. Furthermore, the ventilating fan 505 is normally positioned on top of and in approximate bilateral center of the apparatus body 501, next to the wave-guide 510, so that the distances from the two intake openings 512*a* and 512*b* of the apparatus body are nearly equal, thereby the two intake openings 512*a* and 512*b* of the apparatus body suck the gaseous product in substantially equal quantity. As a result, the drawing efficiency is increased.

In the conventional heating cooker, however, if an outer diameter of the ventilating fan 505 is to be increased in order to enhance the exhausting air flow, the upper wall of the heating chamber 506 must be lowered to obtain a space to fit the ventilating fan 505, which consequently requires the apparatus body 501 to be extended vertically by lowering the bottom wall of the heating chamber 506 in order to also maintain the space large enough to contain a sizable food. If the apparatus body 501 is dimensionally increased thereby reducing a space below the apparatus body 501, placement of a large-sized pan 517 on the second heating cooker 503 such as a gas cooking stove is restricted. This is where a problem exists, i.e., a spatial limitation restricts the degree of freedom in designing, making it a difficult task. In particular, as described in U.S. Pat. No. 4,786,774 a structure, in which the ventilating fan 505 is rotated for changing a direction of the exhausting air-flow upward, rearward or forward, requires a square space in cross sectional dimensions, which imposes another problem of further restricting the designing.

Second, the cooling section for cooling off a machinery compartment 518 is described. A conventional heating cooker employing a range hood of this kind, as shown in FIG. 12, provides cooling air drawn from an intake opening 519 of the machinery compartment located in the upper part of the apparatus body 501 to the cooling fan 509 disposed on rear wall of the machinery compartment 518 and exhausts the air through an exhaust opening 520 of the machinery compartment located in the upper part of the apparatus body 501, and at the same time, the gaseous product generated by the second heating cooker 503 situated below is ventilated by drawing it through the intake openings 512*a* and 512*b* of the apparatus body and exhausted outside by the ventilating fan 505. As the depth of the machinery compartment 518 is extensive, a ventilation air path 521 is provided on the side of the machinery compartment 518, as described in U.S. Pat. No. 4,886,046.

In the conventional heating cooker employing a range hood, however, a problem of a low exhausting efficiency exists, because the cooling fan 509 is stored in a rear part of the machinery compartment 518, which causes a depth of the machinery compartment 518 so wide that it obstructs the ventilation air path 521 of the ventilating fan 505. Furthermore, if a volume of the heating chamber 506 is increased, it forces the machinery compartment 518 to be moved toward the ventilation air path 521, resulting in a narrower ventilation air path 521 and a longer path between the ventilating fan 505 and the ventilation air path 521, and to causes a problem of further lowering the exhausting efficiency. In particular, the structure as described in U.S. Pat. No. 4,886,046, where temperature detecting means is arranged in vicinity of the control device 508 to lower a temperature of the control device 508 by automatically operating the ventilating fan 505 when a detected temperature reaches at a set-temperature, has a problem that the control device 508 tends to heat up fast, and is liable to exceed an allowable temperature limit of its components if the exhausting efficiency is lowered. There is yet another problem that lowers the exhausting efficiency due to this structure in that the intake opening 519 of the machinery compartment and the exhaust opening 520 of the machinery compartment adjoin each other, so that the exhausted air tends to be redrawn for recirculation into the intake opening 519 of the machinery compartment.

Furthermore, the conventional heating cooker employing a range hood comprises a louver 522 over the exhaust opening 513 of the apparatus body, as shown in FIG. 13, through which air is exhausted out of the machinery compartment. However, this structure of the conventional heating cooker tends to soil the louver 522 with gaseous product generated by the food being heated. If an opening area of the louver 522 is reduced so as to make the soil inconspicuous, a volume of air exhausted from the heating chamber 506 and the machinery compartment 518 is also reduced, which on the other hand promotes soiling of an interior of the heating chamber 506 and makes the machinery compartment 518 liable to exceed an allowable temperature limit of the components therein.

SUMMARY OF THE INVENTION

An object of the present invention is to provide a heating cooker which is installable in a restricted space in kitchen. The heating cooker comprises a ventilating fan having a large air exhaust capacity with low noise, a large heating chamber capable of heating and cooking a large mass of foods, and a compact yet efficient cooling means. First, with regard to a range hood section, the present invention is to provide an upper wall of the heating chamber in an area where the ventilating fan is disposed with a recessed portion formed toward an interior side of the heating chamber.

Based on this invention, a space large enough to dispose the ventilating fan is secured so that a diameter of the ventilating fan can be enlarged without lowering whole of the upper wall of the heating chamber. Accordingly, the invention can increase an air exhaust capacity and allows to heat a large mass of food without increasing dimensions of the apparatus body. The invention also makes possible to place large sized pans on a second heating cooker such as a gas cooking stove.

A further improvement of the present invention is to dispose the ventilating fan beside an end of a wave-guide where a feeding port to the heating chamber is located or beside another end where a high frequency generating apparatus is attached.

Based on this invention, in order to enlarge the heating chamber as large as possible under the dimensional restriction of the apparatus body, it is possible to use a wider space for mounting the ventilating fan and the waveguide even if a turn-table is disposed in the recessed portion, and the air exhaust capacity can be increased by extending the outer diameter of the ventilating fan without increasing dimensions of the apparatus body regardless of the location and dimensions of the wave-guide, since they are not arranged side by side on the upper center of the heating chamber.

In an arrangement where a first heating cooker is placed at an upper location and a second heating cooker is placed at a lower location, a yet further improvement of this invention relates to cooling means, i.e., a cooling fan for the first heating cooker is disposed on an upper part of a machinery compartment. The arrangement also comprises one or more openings located in a bottom wall of the machinery compartment, an exhaust path of a cooling air so arranged that it passes a space underneath a bottom wall of the heating chamber after passing through the openings and then through a space by a side wall of the heating chamber opposite to the machinery compartment, and an exhaust opening of the cooling air located on the opposite side of a first intake opening.

The above-described invention improves, without enlarging dimensions of the apparatus body, a ventilating efficiency by providing a wider ventilation path behind the machinery compartment so as to enable a second fan for the ventilation to draw air freely, as a result of positioning the cooling fan for the first heating cooker on the upper part of a machinery compartment, which also reduces a depth of the machinery compartment. The invention also effectively cools down the machinery compartment since once exhausted cooling air is not likely to reenter into the first intake opening because the cooling air passes through the space underneath the bottom wall of the heating chamber and exits from the exhaust opening located on the opposite side of the intake opening.

A still further improvement of the present invention is to dispose an openable door either on the intake opening or on the exhaust opening of the apparatus body.

The above-described invention makes a soil on an exterior side surface of the door inconspicuous because the contaminated air passes through an internal surface of the door facing toward the apparatus body when the air is drawn or exhausted. Also, the door needs not to be small in size, because of the soil on the door being inconspicuous, therefore, an enough air for the intake or the exhaust is maintained so as to lessen soiling of the heating chamber interior and to lower temperatures of components inside the machinery compartment.

DESCRIRPTION OF THE EXEMPLARY EMBODIMENT OF THE INVENTION

First Embodiment

Figure 1:
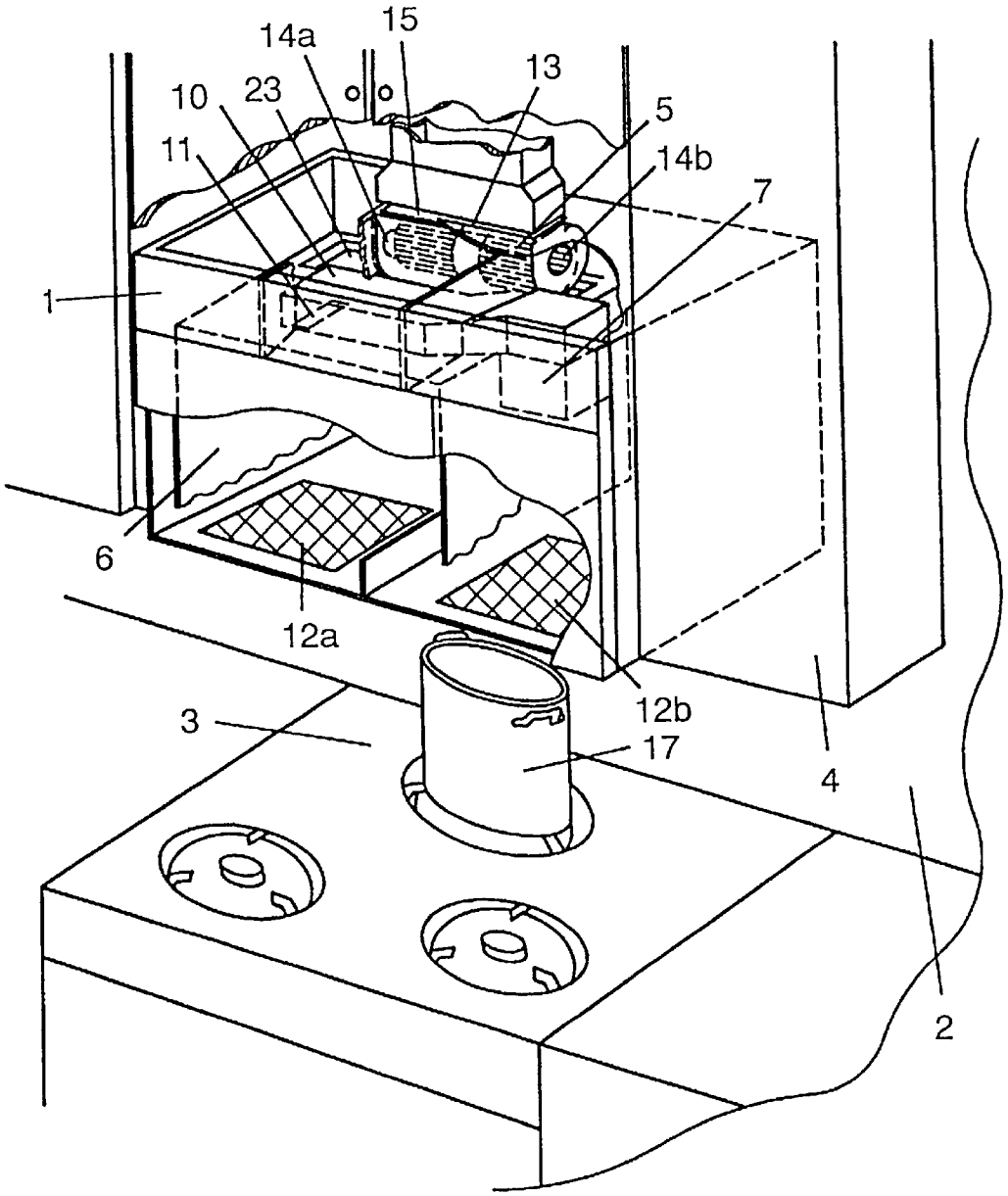
FIG. 1 is a perspective view of a heating cooker of a first embodiment of the present invention.
Figure 2:
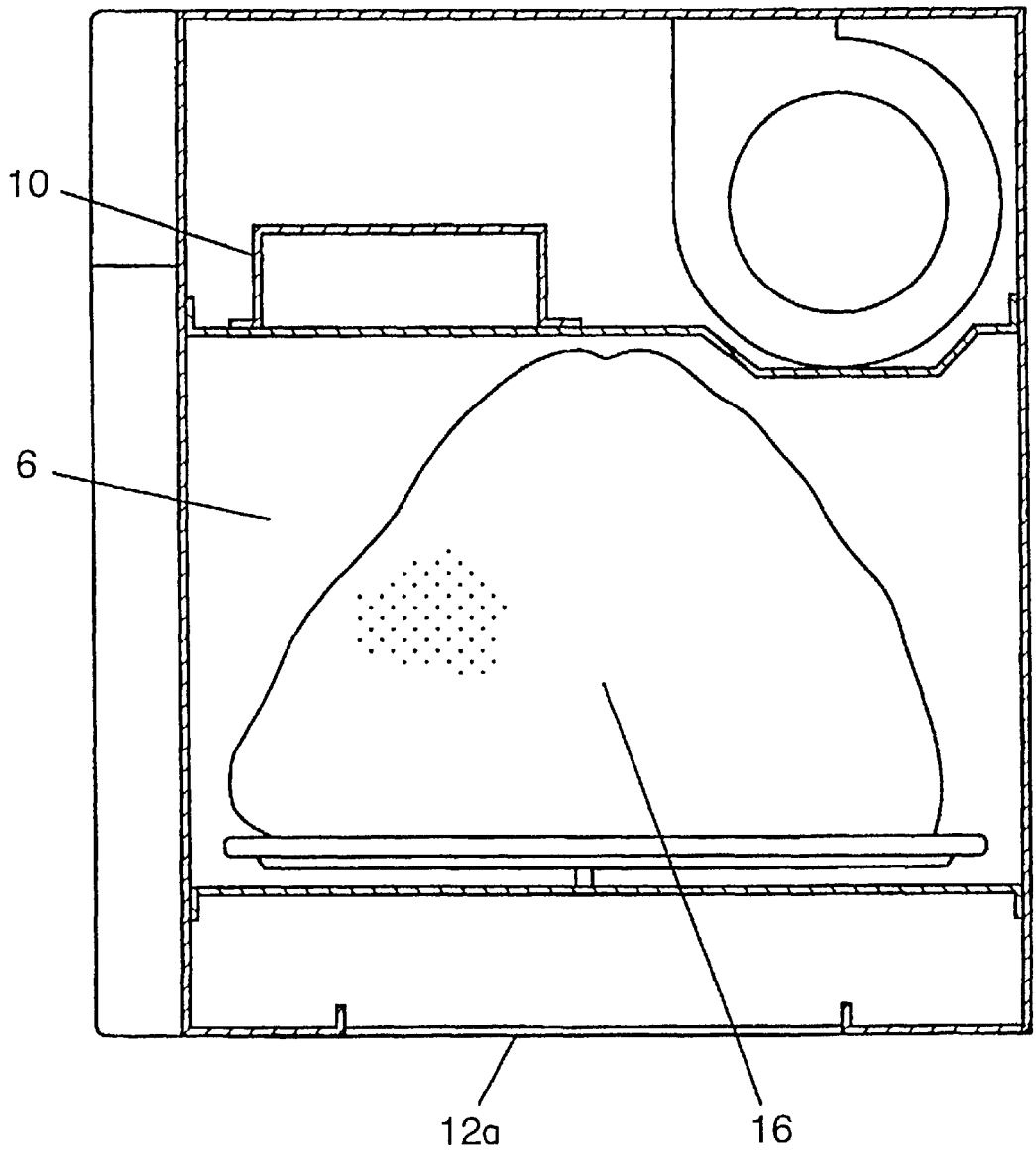
FIG. 2 and FIG. 3 are cross-sectional views of essential portions of the first embodiment.
Figure 3:
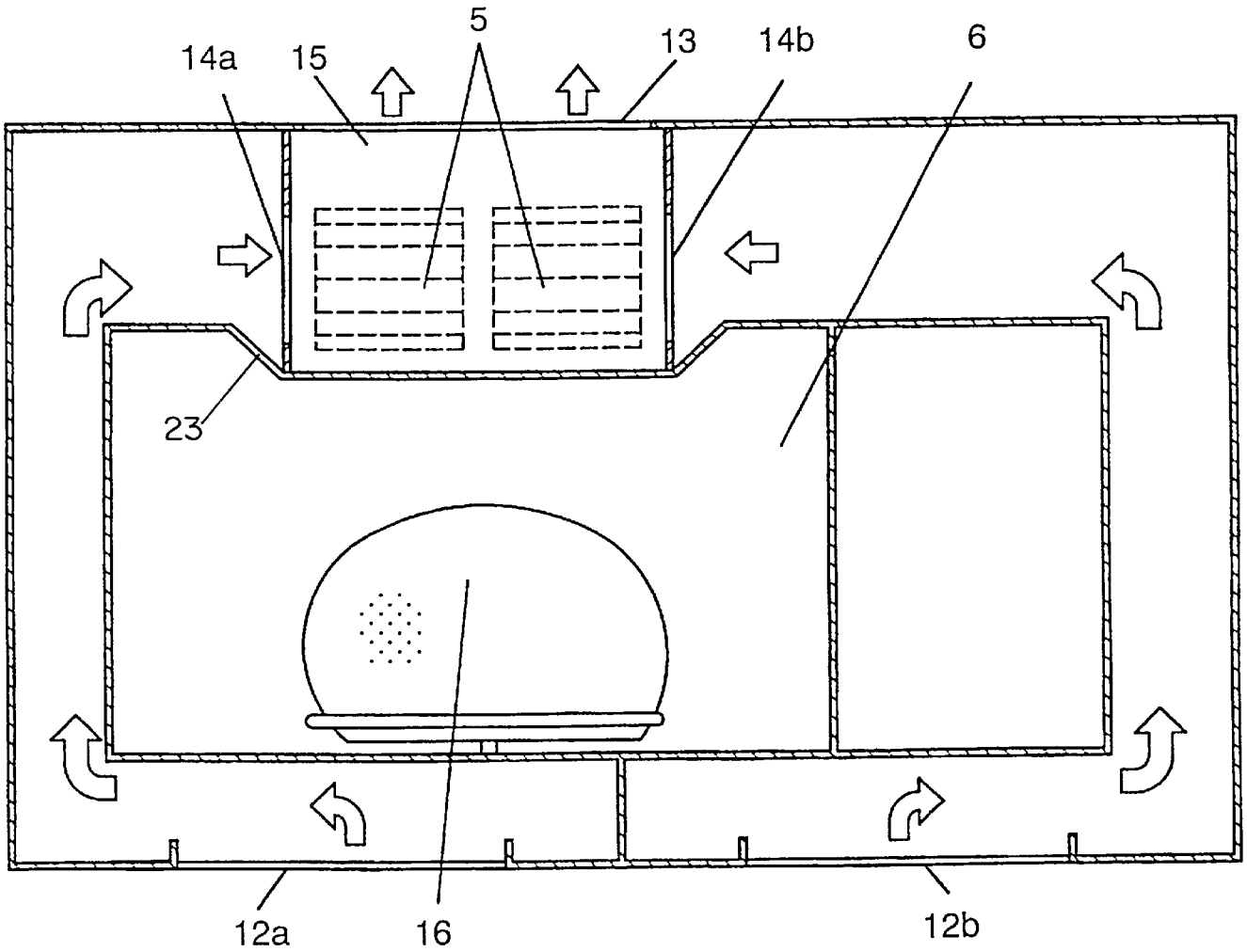

FIG. 1 is a perspective view of a high frequency heating cooker employing a range hood of a first embodiment of the present invention, and FIG. 2 and FIG. 3 are cross-sectional views of essential portions of the high frequency heating cooker.

In the drawings, a heating chamber 6 is a place where food is placed for cooking. A wave-guide 10 is disposed on an upper part of the heating chamber 6 to transmit high frequency energy generated by a high frequency generating apparatus 7. A feeding port ll, through which the high frequency energy is supplied from the wave-guide 10 into the heating chamber 6, is located in an approximate center of the upper part of the heating chamber 6 in order to bilaterally uniformalize the high frequency energy distribution within the heating chamber 6. On the other hand, at an underside of an apparatus body 1, intake openings 12*a* and 12*b* of an apparatus body are provided to draw air containing gaseous product generated by another heating cooker 3 such as a gas cooking stove, and the drawn air is exhausted outside by a ventilating fan 5 through an exhaust opening 13 of the apparatus body and an attached air duct. The ventilating fan 5 is positioned on an upper rear area at approximate center of the heating chamber 6, and a recess 23 is formed toward an interior side of the heating chamber symmetrically with regard to the heating chamber 6 at an area of an upper wall of the heating chamber 6 where the ventilating fan 5 is situated. The ventilating fan 5 has intake openings 14*a* and 14*b* for the ventilating fan at both ends of suction side of the ventilating fan, and flow communications are made independently through ventilation air paths, between the intake opening 12*a* of the apparatus body and the intake opening 14*a* of the ventilating fan and, between the opening 12*b* and the opening 14*b*, respectively. An exhaust opening 15 for the ventilating fan is provided at the venting side. The wave-guide 10 is curved at a side of the ventilating fan 5 near the high frequency generating apparatus 7.

An operation and a function of the high frequency heating cooker are described below. An outer diameter of the ventilating fan 5 can be increased by a depth of the recess 23 because certain area of the upper wall of the heating chamber 6 on which the ventilating fan 5 is situated is recessed. Without enlarging the dimension of the apparatus body 1, this enhances a ventilation capacity and retains a height of an essential portion of the heating chamber 6 where a food to be heated is placed. This also allows placing large-sized pans on another heating cooker 3 such as a gas cooking stove because a vertical dimension of the apparatus body 1 needs not be increased.

The ventilating fan 5 is able to ventilate effectively avoiding uneven drawing of air between the intake openings 12*a* and 12*b* of the apparatus body even if the ventilating fan 5 is not situated in a bilateral center of the apparatus body 1, since air drawn from the intake opening 12*a* of the apparatus body is delivered into the intake opening 14*a* for the ventilating fan and air drawn from the intake opening 12*b* of the apparatus body is delivered into the intake opening 14*b* for the ventilating fan independently because the ventilating fan 5 has the intake openings 14*a* and 14*b* for the ventilating fan at both ends of suction side of the ventilating fan and are communicated with the intake openings 12*a* and 12*b* of the apparatus body by individually independent ventilation air paths.

The upper wall of the heating chamber 6 where the ventilating fan 5 is situated is recessed symmetrically with regard to the heating chamber 6, that it produces a symmetrically even distribution of the high frequency energy to achieve a uniform heating of the food 16 to be heated.

Furthermore, the ventilation of a sufficient capacity can be obtained by increasing the diameter of the ventilating fan 5, and transmission efficiency of the high frequency energy can be enhanced by broadening a width of the waveguide 10, since the wave-guide 10 is curved between the high frequency generating apparatus 7 and the feeding port 11 avoiding the wave-guide 10 to interfere with the ventilating fan 5.

Second Embodiment

Figure 4:
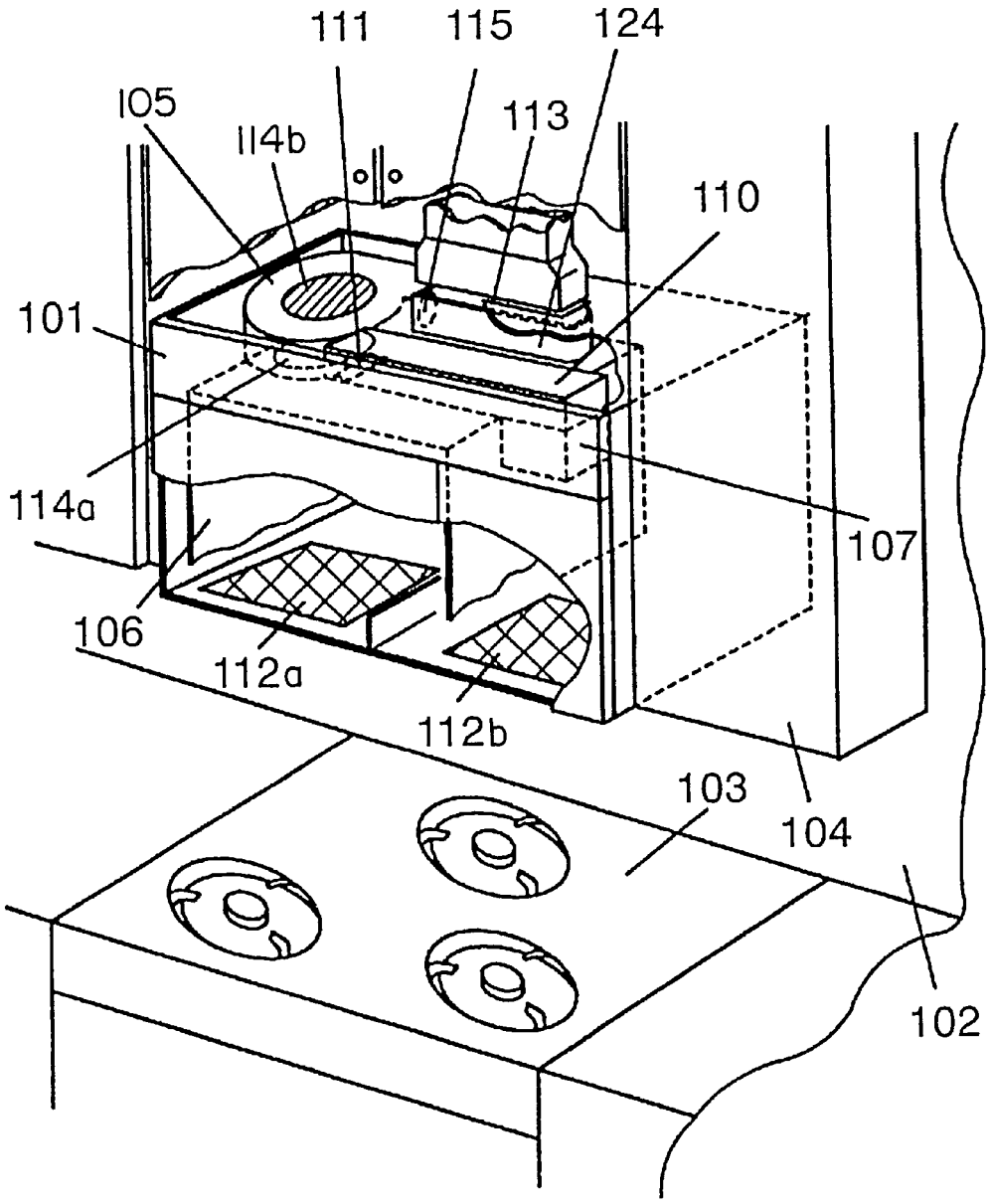
FIG. 4 is a perspective view of a heating cooker of a second embodiment of the present invention.
Figure 5:
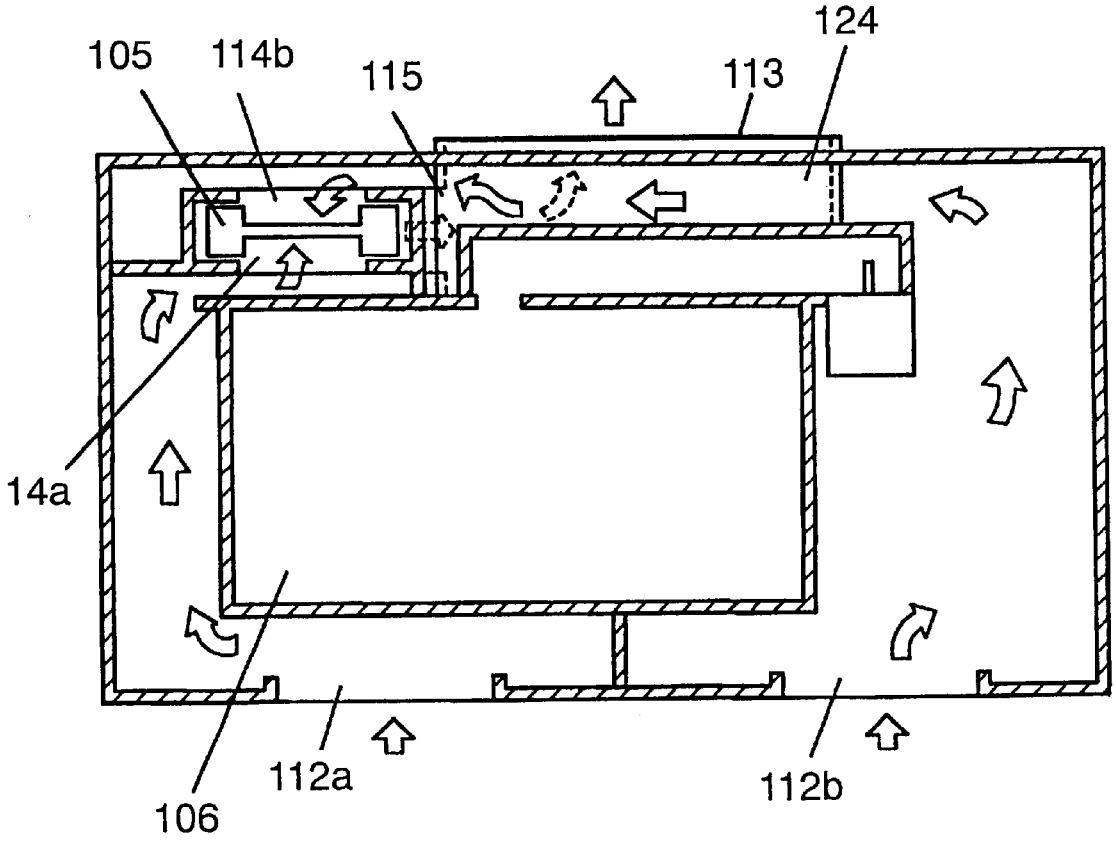
FIG. 5, FIG. 6A, FIG. 6B and FIG. 6C are cross-sectional views of essential portions of the second embodiment.

FIG. 4 is a perspective view of a high frequency heating cooker employing a range hood of a second embodiment of the present invention, and FIG. 5, FIG. 6A, FIG. 6B and FIG. 6C are cross-sectional views of essential portions of the high frequency heating cooker.

An apparatus body 101 comprises a heating chamber 106 where food is placed and cooked. A wave-guide 110 is disposed on an upper part of the heating chamber 106 to transmit high frequency energy generated by a high frequency generating apparatus 107. A feeding port 111 is located in an approximate center of the upper part of the heating chamber 106 in order to supply the high frequency energy from the wave guide 110 into the heating chamber 106, and to bilaterally uniformalize the high frequency energy distribution within the heating chamber 106. On the other hand, at an underside of the apparatus body 101, intake openings 112*a* and 112*b* of the apparatus body are provided to draw air containing gaseous product generated by another heating cooker 103 such as a gas cooking stove, and the drawn air is exhausted outside through an exhaust opening 113 of the apparatus body and an attached air duct by a ventilating fan 105 which is disposed beside an end of the wave-guide 110 by the feeding port 111. The ventilating fan 105 has intake openings 114*a* and 114*b* for the ventilating fan at both upper and lower ends of suction side of the ventilating fan 105, and flow communications are made independently through ventilation air paths, between the intake opening 112*a* of the apparatus body and the intake opening 114*a* for the ventilating fan and, between the opening 112*b* and the opening 114*b* respectively. An exhaust opening 115 for the ventilating fan is provided at the venting side of the ventilating fan 105. The ventilating fan 105 is provided with an exhaust duct 124 which makes a connection between the exhaust opening 115 for the ventilating fan and the exhaust opening 113 of the apparatus body. The exhaust duct 124 is rotatably attached to the exhaust opening 115 for the ventilating fan.

An operation and a function are described below. In FIG. 4, the ventilating fan 105 is disposed at the left side of the wave-guide 110 near the end by the feeding port 111, yet it can be arranged at the right side of the waveguide 110, i.e., at the other end of the wave-guide 110 by the high frequency generating apparatus 107. Alternatively, a plurality of the ventilating fans 105 may be arranged at both ends of the wave-guide 110. Accordingly, this enables to increase a ventilation capacity without increasing dimensions of the apparatus body 101 because a diameter of the ventilating fan 105 can be increased up to a dimension equal to an internal depth of the apparatus body 101 since the ventilating fan 105 may be arranged at either one or both ends of the wave-guide 110 regardless of a position and dimensions of the wave-guide 110. Also, because the ventilating fan 105 shown in FIG. 4 is of a flat type, a ventilation capacity of it can be increased without extending a vertical height of the high frequency heating cooker employing a range hood.

Figure 6A:
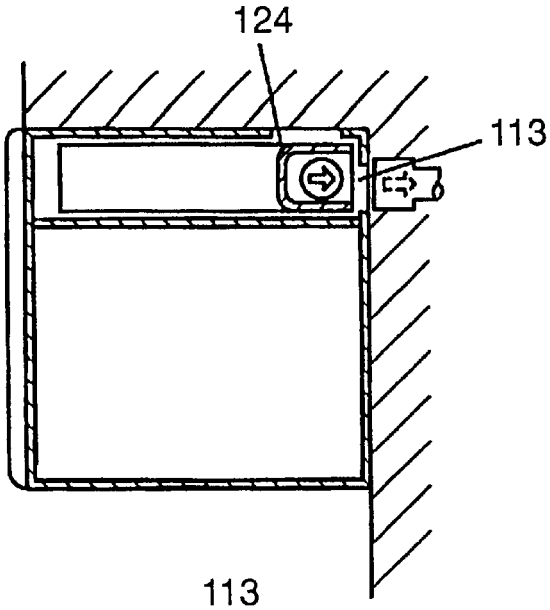
Figure 6B:
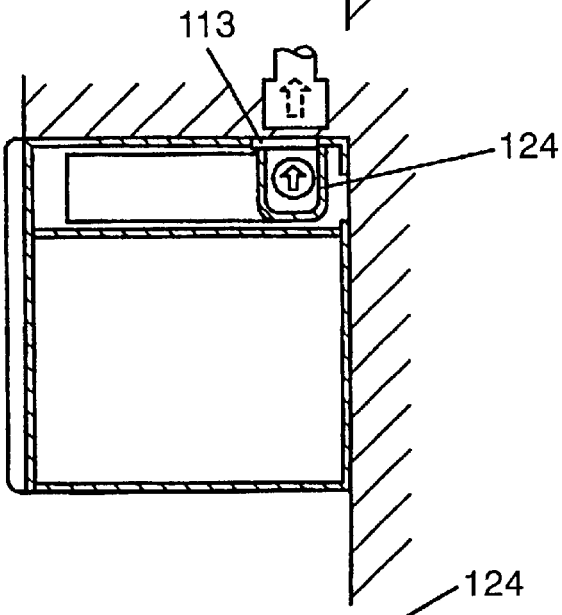
Figure 6C:
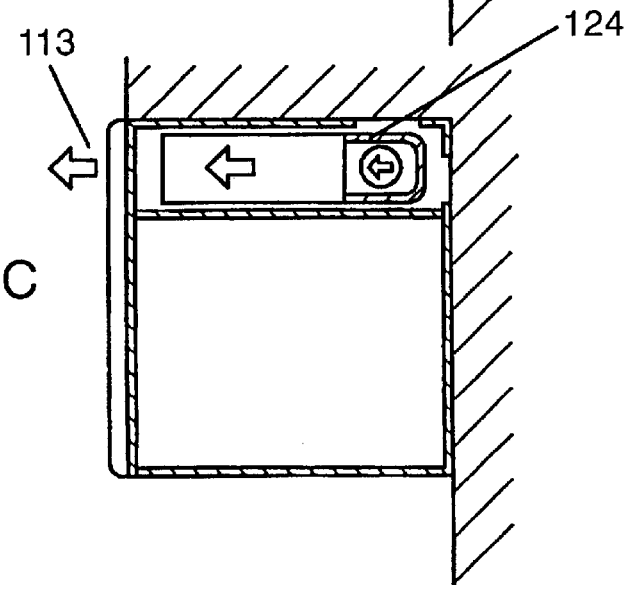

Furthermore, the ventilating fan 105 is able to ventilate effectively without having an uneven drawing of air between the intake openings 112*a* and 112*b* of the apparatus body even if the ventilating fan 105 is not situated above an upper center part of the heating chamber 106, since air drawn from the intake opening 112*a* of the apparatus body is delivered into the intake opening 114*a* for the ventilating fan and air drawn from the intake opening 112*b* of the apparatus body is delivered into the intake opening 114*b* for the ventilating fan independently, because the ventilating fan 105 has the intake openings 114*a* and 114*b* for the ventilating fan at both upper and lower ends of suction side of the ventilating fan 105 and that these intake openings are flow communicated with the intake openings 112*a* and 112*b* of the apparatus body by individually independent ventilation air paths, Additionally, since the exhaust duct 124 for the ventilating fan is disposed rotatably, an exhausting direction is easily changeable upon installation by turning an orientation of the exhaust duct 124 for the ventilating fan, in any case of the exhaust opening 113 of the apparatus body which may face toward rear, upside or front of the apparatus body 101 depending on circumstance of the installation of an exhaust duct for outside, as shown in FIGS. 6A, 6B and 6C.

Third Embodiment

Figure 7:
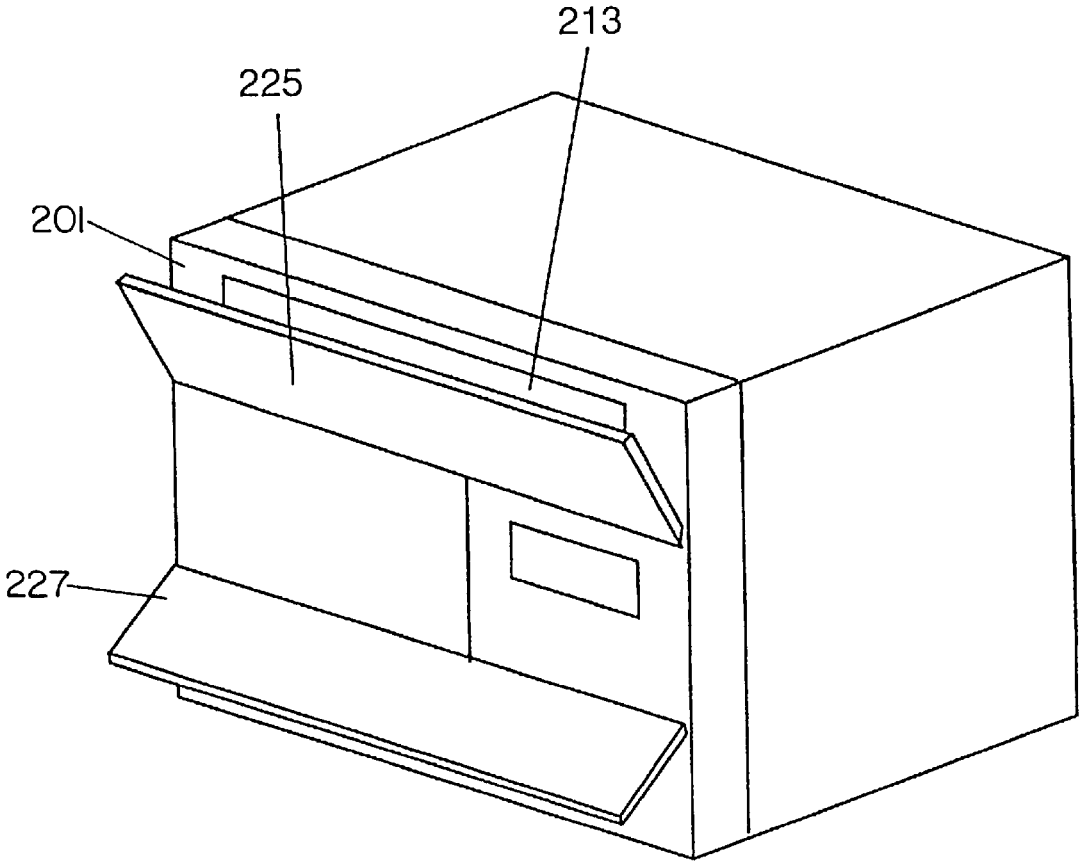
FIG. 7 is a perspective view of a heating cooker of a third embodiment of the present invention.
Figure 8:
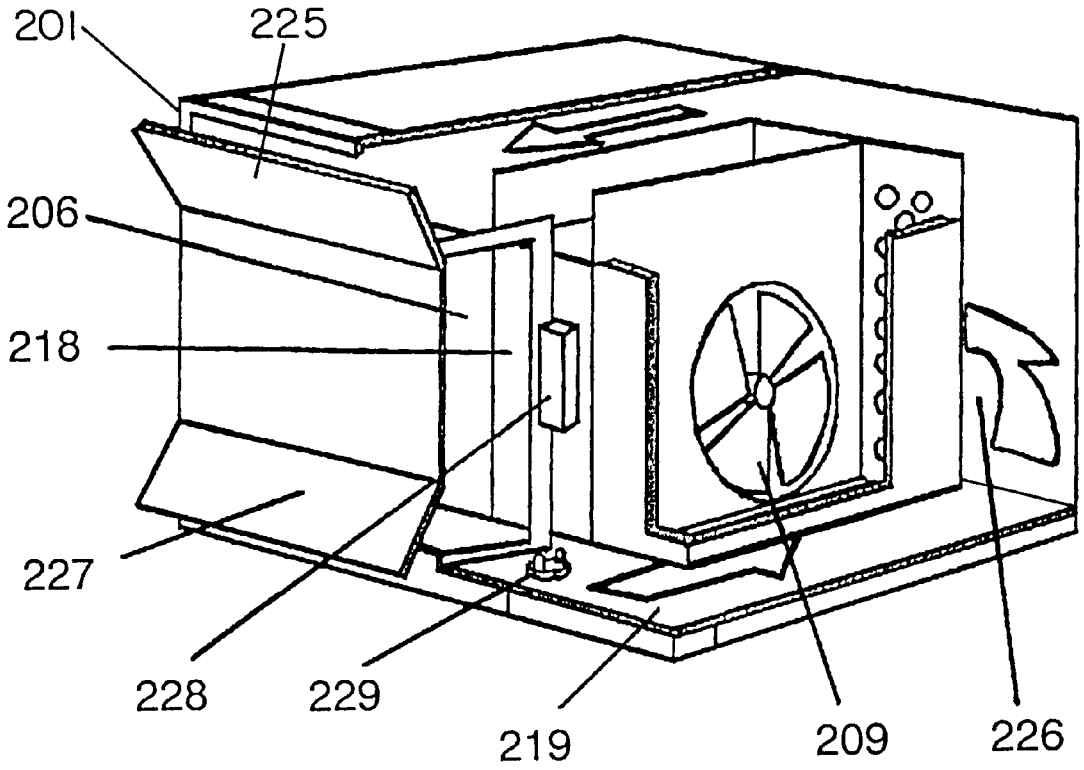
FIG. 8 is a cross-sectional view of an essential portion of the third embodiment.

FIG. 7 is a perspective view of a heating cooker of a third embodiment of the present invention, and FIG. 8 is a cress-sectional view of an essential portion of the heating cooker.

In the figures, an exhaust opening 213 of an apparatus body is to exhaust air from inside of an apparatus body, and a first door 225 is attached openably to the exhaust opening 213 of the apparatus body. A heating chamber 206 stores a food to be heated. A machinery compartment 218 comprises a magnetron tube and others to generate high frequency waves. A cooling fan 209 ventilates air inside the heating chamber and the machinery compartment. An intake air path 226 is a passage to conduct cooling air into the heating chamber and the machinery compartment. A second door 227 introduces air external of the apparatus body into the intake air path 226, and an intake opening 219 of the machinery compartment draws the air through the second door 227 which is attached openably. The cooling air drawn through the intake opening 219 of the machinery compartment is directed toward inside of the machinery compartment 218 and the heating chamber 206 by the cooling fan 209. The air from the machinery compartment 218 and the heating chamber 206 is exhausted after passing through an internal surface, i.e., a surface facing toward the apparatus body side, of the first door 225 open to upward. The exhausted air out of the apparatus body is then exhausted outside through a ventilation opening provided above the heating cooker. A control apparatus 228 bears a function to open and close the first door 225 and the second door 227. A temperature detecting switch 229 detects a temperature external of the apparatus body.

An operation and a function are described below. When the air surrounding the apparatus body is contaminated with oil laden smoke coming out of a food being cooked by, for instance, a gas cooking stove in a vicinity of the apparatus body, the air to be drawn through the intake opening 219 of the machinery compartment passes the second door 227 along a surface facing the apparatus body side so as to keep an exterior side surface of the second door 227 insusceptible to soiling. Similarly, gaseous product emitted from a food inside of the heating chamber 206 passes the first door 225 along a surface facing the apparatus body side before being exhausted through the ventilation opening so as to keep an exterior surface, i.e., a surface external of the apparatus body, of the first door 225 insusceptible to soiling.

Besides, the first door 225 and the second door 227 are kept closed when the cooling fan 209 is not operating, thereby eliminates irregularities of the apparatus body surface so as to make a cleaning task easier and, in addition, to prevent dusts and other foreign objects from entering.

Further, the temperature detecting switch 229 detects a conducted heat from adjoining parts of the apparatus body 201, and opens the first door 225 and the second door 227 to cool components inside the machinery compartment 218 by running the cooling fan 209 at the same time.

Forth Embodiment

Figure 9:
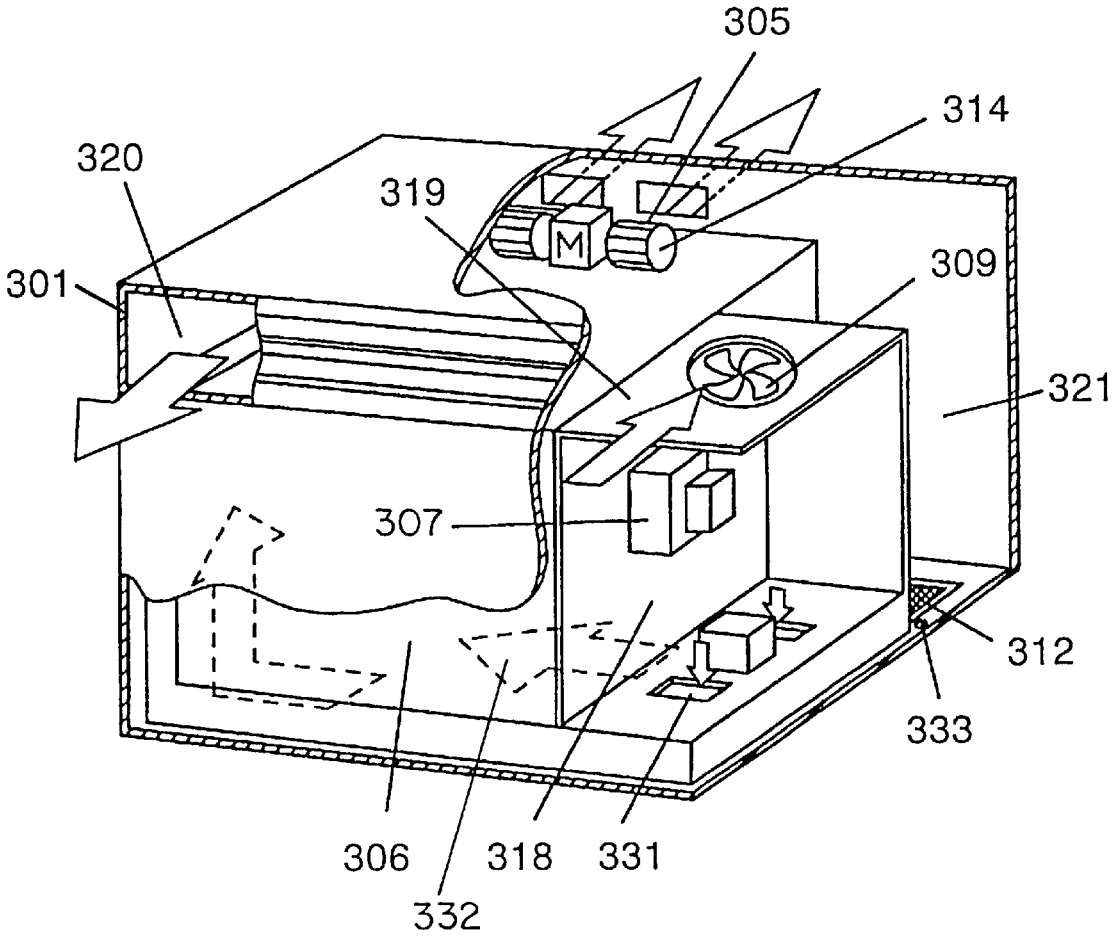
FIG. 9 is a cross-sectional view of an essential portion of a forth embodiment.
Figure 10:
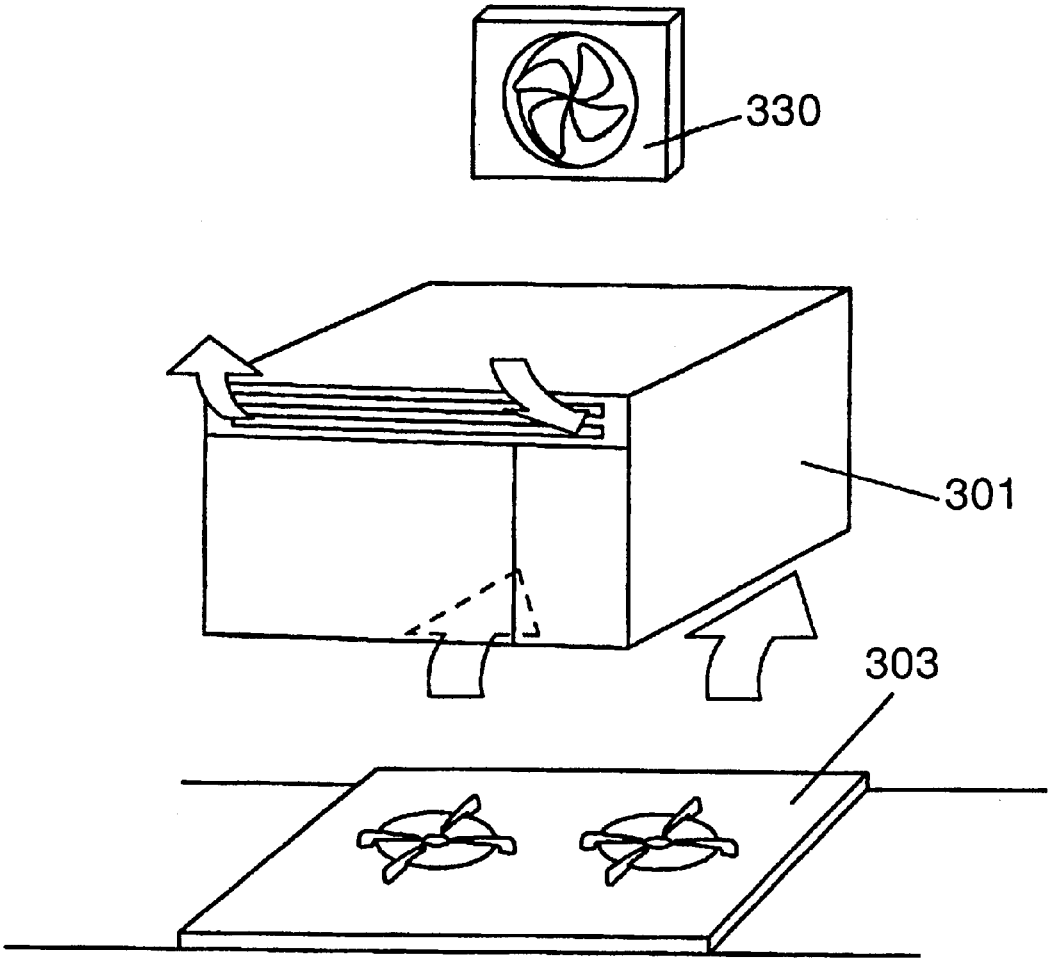
FIG. 10 depicts an outline structure of the forth embodiment.
Figure 11:
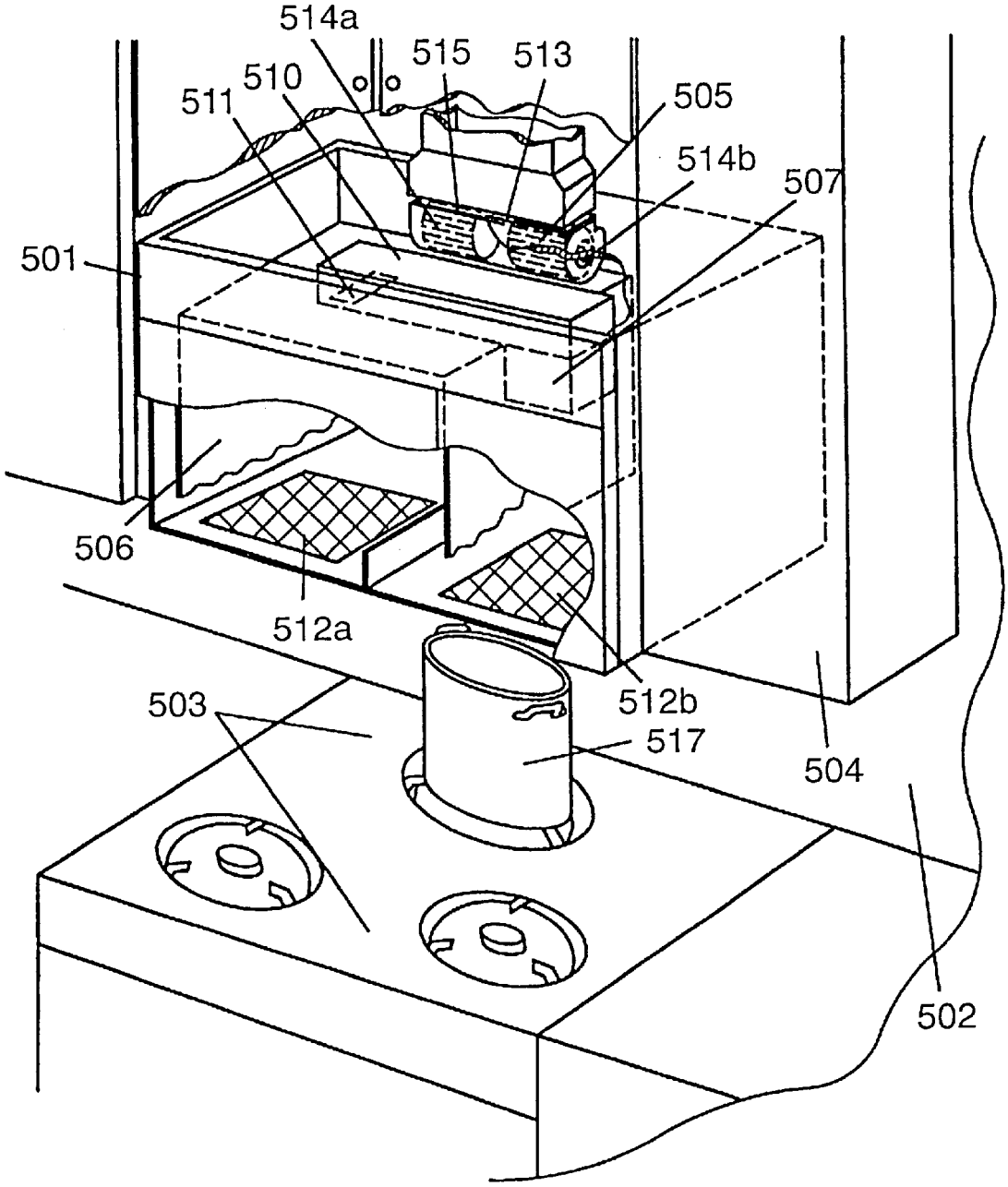
FIG. 11 (PRIOR ART)
FIG. 11, FIG. 12 and FIG. 13 are perspective views of a conventional heating cooker employing a range hood.
Figure 12:
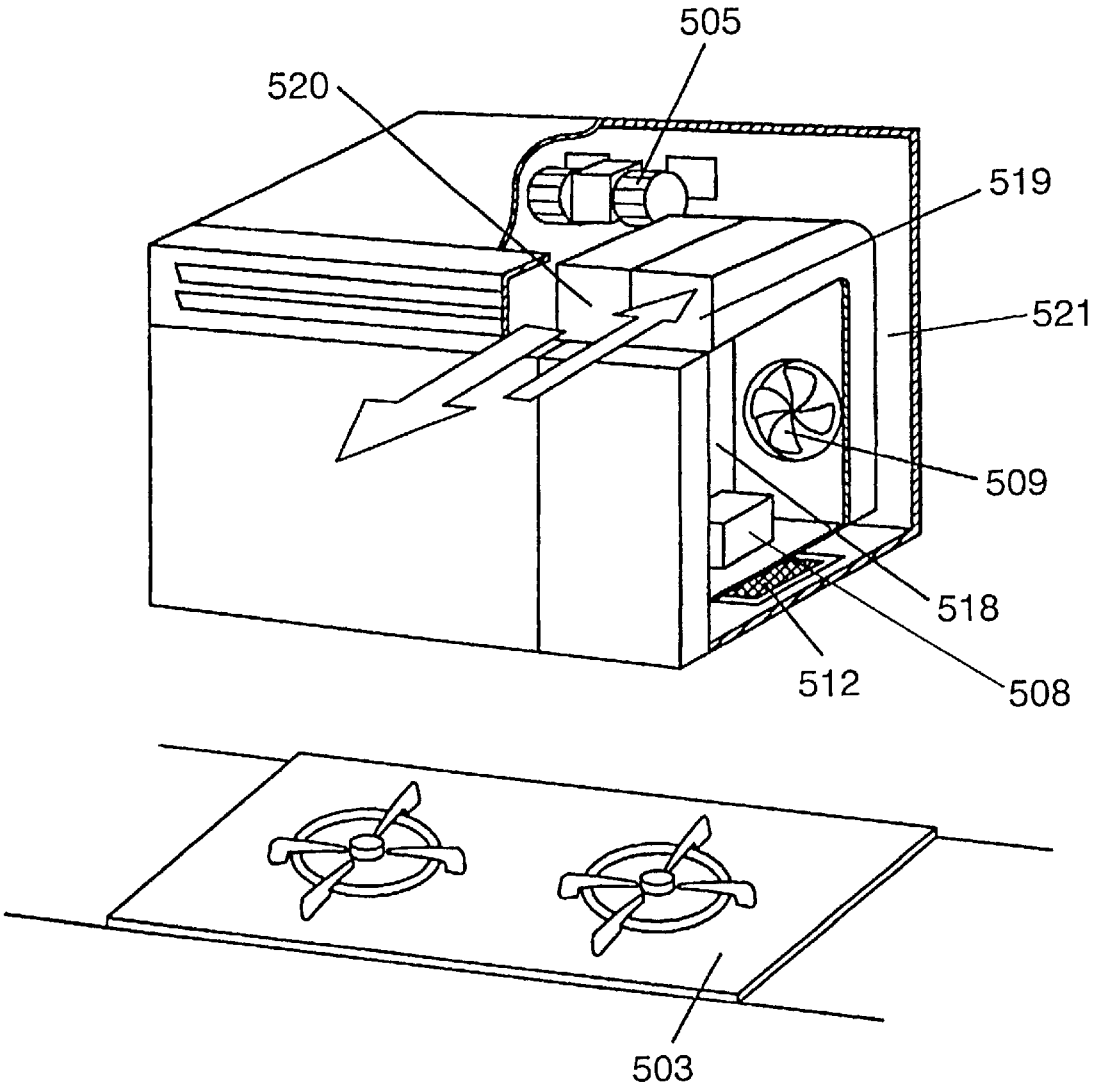
FIG. 12 (PRIOR ART)
Figure 13:
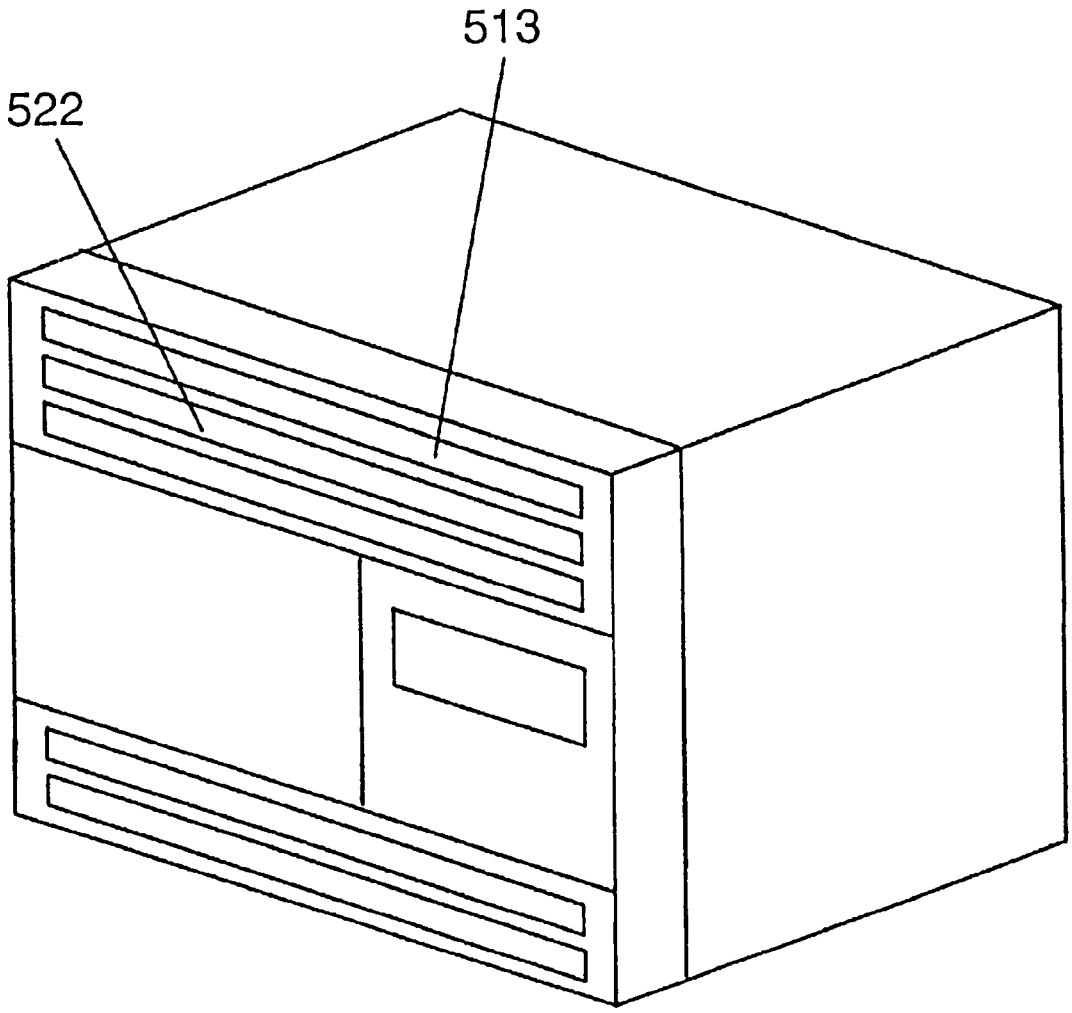
FIG. 13 (PRIOR ART)

FIG. 9 is a cross-sectional view of an essential portion of a heating cooker employing a range hood of a forth embodiment of the present invention, and FIG. 10 depicts an outline structure of a heating cooking system incorporating the heating cooker employing a range hood.

In FIG. 9 and FIG. 10, an apparatus body 301 comprises the heating cooker employing a range hood, and a gas cooking stove 303 defining another heating cooker installed below the apparatus body 301. An extractor fan 330 is equipped above the apparatus body 301. The apparatus body 301 encloses a heating chamber 306 to store food to be cooked and a machinery compartment 318 comprising a heating means 307 such as a magnetron tube to generate high frequency waves. An intake opening 319 of the machinery compartment is to introduce into the machinery compartment 318 a flow of cooling air drawn by a cooling fan 309. The cooling fan 309 is disposed on an upper part of the machinery compartment 318 so as to secure a space behind the machinery compartment 318. One or more openings 331 are provided on a bottom part of the machinery compartment 318, and through an exhaust air path 332 the cooling air is exhausted from an exhaust opening 320 of the machinery compartment after components inside the machinery compartment 318 are cooled, and the cooling air is then expelled outside by the extractor fan 330. The exhaust opening 320 of the compartment and the intake opening 319 of the electronics module compartment are separated and are independently disposed at both ends of the apparatus body with the heating chamber 306 between them.

On the other hand, gaseous product generated by another heating cooker 303 is exhausted outside by a ventilating fan 305 after passing through an intake opening 312 disposed in the base of the apparatus body and a ventilation air path 321 disposed in the back of the machinery compartment 318. The ventilating fan 305 is disposed at an upper rear part of the heating chamber, and an intake opening 314 for the ventilating fan 314 is connected to the ventilation air path 321 behind the machinery compartment.

A thermister 333 defines temperature detecting means placed on a bottom part of the apparatus body. The thermister detects a temperature risen by convection or radiation of heat when the apparatus body 301 or the another heating cooker 303 is used.

An operation and a function are described below. The ventilating fan 305 is able to effectively ventilate gaseous product from the another heating cooker 303 because the cooling fan 309 is disposed on the upper part of the machinery compartment 318 so as not to obstruct the ventilation air path 321 behind the machinery compartment 318. Also, as the cooling air once used to cool the machinery compartment 318 is not drawn again into the intake opening 319 of the machinery compartment because the intake opening 319 of the machinery compartment and the exhaust opening 320 of the machinery compartment are separated and independently disposed, so that the air can efficiently cool the components inside of the machinery compartment 318. Due to an arrangement that the intake opening 319 of the machinery compartment is disposed at the upper part and the intake openings 312 of the apparatus body at the lower part of the apparatus body, most of the exhaust emitted by the another heating cooker 303 is drawn into the intake openings 312 of the apparatus body so as to prevent an ambient temperature around the upper part of the apparatus body 301 from rising, thereby allowing the intake opening 319 of the machinery compartment to collect cool air, that efficiently cools the components inside the machinery compartment 318.

Furthermore, the temperature detecting means 333 activates the ventilating fan 305 automatically if a user has not turned on the ventilating fan 305 while using the apparatus body which causes a temperature of the apparatus body to rise by conduction of a heat, and the same temperature detecting means also activates the ventilating fan 305 automatically if the user uses the another heating cooker 303 which also causes a temperature of the apparatus body to rise by radiation of a heat, so as to effectively lower temperatures of the components inside the machinery compartment 318.

Although a structure in which the ventilating fan 305 is located at the approximate center of the upper wall of the heating chamber 306 has been described in the fourth embodiment above, this does not set limits to other structures, such that the ventilating fan 305 may be located beside an end of a wave-guide 310 near a feeding port 311 for the heating chamber 306 or beside another end near a high frequency generating apparatus 307.

Because a certain area of the upper wall of the heating chamber on which the ventilating fan is situated is recessed, as described above, the present invention has an advantageous result which enables to increase a diameter of the ventilating fan by a depth of the recess so as to enhance a ventilation capacity without enlarging dimensions of the apparatus body, and to retain the heating chamber for storing a food to be cooked with a sufficient height to cook a sizable food.

The ventilating fan is able to ventilate efficiently without drawing air unevenly among a plurality of the intake openings of the apparatus body even if the ventilating fan is not situated in a lateral center of the apparatus body, because the ventilating fan has the intake openings for ventilating fan at both upper and lower ends of suction side of the ventilating fan and these intake openings are independently connected to each of at least two intake openings of the apparatus body.

Because the recess on the upper wall of the heating chamber is symmetrical in shape with regard to the heating chamber, it can produce a high frequency energy distribution symmetrically so as to achieve a uniform heating of the food to be heated.

Also, the present invention disposes the ventilating fan beside an end of the wave-guide near the feeding port to the heating chamber or beside the another end near the high frequency generating apparatus, that it has an advantage of allowing a diameter of the ventilating fan to be increased up to a dimension equal to an internal depth of the apparatus body regardless of a position or dimensions of the wave-guide so as to enhance a ventilation capacity without enlarging dimensions of the apparatus body.

Also, the ventilating fan is able to ventilate efficiently without drawing air unevenly among a plurality of the intake openings of the apparatus body even if the ventilating fan is not situated on an upper center part of the heating chamber, because the ventilating fan has the intake openings for ventilating fan at both upper and lower ends of suction side of the ventilating fan and these intake openings are independently connected to each of at least two intake openings of the apparatus body.

Additionally, as the exhaust duct for the ventilating fan is rotatably attached to the exhaust opening for the ventilating fan, an exhausting direction is easily changeable upon installation, in any case of the exhaust opening for apparatus body which may face toward rear, upside or front depending on circumstance of the installation of the exhaust duct for outside.

Also, the present invention attaches a door openably either to the intake opening or to the exhaust opening of the apparatus body, which leads the contaminated air to pass through the surface of the open door facing toward the apparatus body side when the air is drawn or vented, so that it has an advantage of keeping a soil on an exterior side surface of the door inconspicuous.

Consequently, as the door needs not to be small in size, a sufficient intake or exhaust airflow can be maintained to reduce soiling in the heating chamber and to lower temperature of the component parts inside of the machinery compartment.

Besides, the door may be kept closed when the fan is not operating, thereby eliminates irregularities of the apparatus body surface so as to make a cleaning task easier, and to prevent dusts and other foreign objects from entering.

Further, a detecting means for a temperature external of the apparatus body detects a heat conducted from other adjoining apparatus, and opens the door and activates the fan so as to cool the components inside of the machinery compartment.

Also, the present invention has an advantageous result for improving a ventilating efficiency by disposing the first fan on the upper part of the machinery compartment so as to reduce a depth of the machinery compartment, which gives a wider ventilation path behind the machinery compartment and allows the second fan to freely draw the gaseous product emitted by the second heating cooker.

What is claimed is:

1. A high frequency heating cooker employing a range hood for installation in a limited space above a second heating cooker, said high frequency heating cooker comprising:

an apparatus body having a food heating chamber therein;

a high frequency generating apparatus;

a feeding port located at approximately a center of an upper part of said heating chamber;

a high frequency wave-guide operably coupling said high frequency generating apparatus to said feeding port;

wherein said apparatus body has an intake opening through which gaseous products generated by the second heating cooker are to be drawn, and an exhaust opening through which the gaseous products are to be exhausted from said apparatus body;

wherein said heating chamber has an upper wall, and said upper wall has a portion recessed inwardly toward said heating chamber so as to form an upwardly opening recess and a downwardly projecting projection extending into an interior of said heating chamber; and wherein a ventilating fan, operably connected to said intake opening and said exhaust opening, is mounted in said recess on said upper wall of said heating chamber.

2. The heating cooker according to claim 1, wherein said intake opening comprises a pair of intake openings; and said ventilating fan has a pair of intake ports arranged at a suction side of said ventilating fan;

wherein said intake openings of said apparatus body are respectively independently connected to said intake ports of said ventilating fan via separate air flow paths.

3. The heating cooker according to claim 2, wherein said wave-guide comprises a curvature portion in at least one location between said high frequency generating apparatus and said feeding port.

4. The heating cooker according to claim 1, wherein said wave-guide comprises a curvature portion in at least one location between said high frequency generating apparatus and said feeding port.

5. The heating cooker according to claim 1, wherein said recess is formed with a symmetrical shape in said upper wall of said heating chamber.

6. The heating cooker according to claim 5, wherein said intake opening comprises a pair of intake openings; and said ventilating fan has a pair of intake ports arranged at a suction side of said ventilating fan;

wherein said intake openings of said apparatus body are respectively independently connected to said intake ports of said ventilating fan via separate air flow paths.

7. The heating cooker according to claim 6, wherein said wave-guide comprises a curvature portion in at least one location between said high frequency generating apparatus and said feeding port.

8. The heating cooker according to claim 5, wherein said wave-guide comprises a curvature portion in at least one location between said high frequency generating apparatus and said feeding port.

9. The heating cooker according to claim 1, wherein said apparatus body includes a machinery compartment therein, and said high frequency generating apparatus is disposed in said machinery compartment;

a second fan is provided for ventilating said heating chamber and said machinery compartment;

said apparatus body includes a second intake opening for drawing air to said second fan;

said apparatus body includes a second exhaust opening for venting gases generated by heating said food; and an openable door is provided on at least one of said second exhaust opening and said second intake opening.

10. The heating cooker according to claim 9, wherein said door is provided on said second exhaust opening and is upwardly openable.

11. The heating cooker according to claim 10, further comprising a controller for controlling opening and closing of said door such that said door is opened when the fan operates, and said door is closed when said fan stops.

12. The heating cooker according to claim 9, further comprising a temperature detector disposed externally of said apparatus body, said temperature detector being operably connected to said door and said second fan such that said door is opened and said second fan is operated when a temperature outside of said apparatus body exceeds a set temperature.

13. The heating cooker according to claim 10, further comprising a temperature detector disposed externally of said apparatus body, said temperature detector being operably connected to said door and said second fan such that said door is opened and said second fan is operated when a temperature outside of said apparatus body exceeds a set temperature.

14. The heating cooker according to claim 9, further comprising a controller for controlling opening and closing of said door such that said door is opened when the fan operates, and said door is closed when said fan stops.

15. The heating cooker according to claim 1, wherein said apparatus body further includes a machinery compartment accommodating said high frequency generating apparatus;

a second fan is provided for ventilating said heating chamber and said machinery compartment;

said apparatus body includes a second intake opening for drawing air to said second fan;

said intake opening through which gaseous products from the second heating cooker are drawn, is disposed at an underside of said apparatus body; and wherein said second fan is mounted on an upper part of said machinery compartment.

16. The heating cooker according to claim 15, wherein an opening is located in a bottom wall of said machinery compartment;

an exhaust air path is arranged for air to pass through said opening, underneath a bottom wall of said heating chamber and on a side of said heating chamber opposite said machinery compartment; and a second exhaust opening, connected to said exhaust air path, is provided in said apparatus body at a side thereof opposite said intake opening through which gaseous products from the second heating cooker are drawn.

17. The heating cooker according to claim 15, further comprising a temperature detector disposed externally of said apparatus body, and being operably connected to said second fan such that said second fan is operated when a temperature outside of said apparatus body exceeds a set temperature.

18. The heating cooker according to claim 16, further comprising a temperature detector disposed externally of said apparatus body, and being operably connected to said second fan such that said second fan is operated when a temperature outside of said apparatus body exceeds a set temperature.

19. A system of heating cookers including a high frequency heating cooker according to claim 1 and located at an upper position, and a second heating cooker located at lower position below said high frequency heating cooker, wherein:

said apparatus body further includes a machinery compartment accommodating said high frequency generating apparatus;

a second fan is provided for ventilating said heating chamber and said machinery compartment;

said apparatus body includes a second intake opening for drawing air to said second fan;

said intake opening through which gaseous products from the second heating cooker are drawn, is disposed at an underside of said apparatus body; and wherein said second fan is mounted on an upper part of said machinery compartment.

20. The system of heating cookers according to claim 19, further comprising a temperature detector for detecting a temperature of said high frequency heating cooker and for operating said second fan when a temperature of said high frequency heating cooker exceeds a set temperature.

21. The system of heating cookers according to claim 19, wherein said second fan of said high frequency heating cooker is operated when said second heating cooker is operated.

22. The system of heating cookers according to claim 20, wherein said second fan of said high frequency heating cooker is operated when said second heating cooker is operated.

23. A system of heating cookers including a high frequency heating cooker according to claim 1, further comprising an extracting fan installed above said high frequency heating cooker for exhausting vented air outside from said high frequency heating cooker.

24. The heating cooker according to claim 1, wherein said recess is formed symmetrically with respect to said heating chamber.

25. A heating cooker comprising:

an apparatus body having a food heating chamber and a machinery compartment provided therein;

a heating mechanism operably connected to said heating chamber and disposed in said machinery compartment;

a first fan operably connected to said heating chamber and said machinery compartment to cool said heating chamber and ventilate said machinery compartment;

a first intake opening for drawing air to said first fan;

a second intake opening provided on an underside of said apparatus body;

a second fan for drawing air through said second intake opening; and wherein said first fan is mounted on an upper part of said machinery compartment and said first intake opening is located adjacent an inlet of said first fan such that air drawn through said first intake opening is drawn in directly by said first fan.

26. The heating cooker according to claim 25, wherein an opening is located in a bottom wall of said machinery compartment;

an exhaust air path is arranged for air to pass through said opening, underneath a bottom wall of said heating chamber and on a side of said heating chamber opposite said machinery compartment; and an exhaust opening, connected to said exhaust air path, is provided in said apparatus body at a side thereof opposite said first intake opening.

27. The heating cooker according to claim 26, further comprising a temperature detector disposed externally of said apparatus body, and being operably connected to said second fan such that said second fan is operated when a temperature outside of said apparatus body exceeds a set temperature.

28. The heating cooker according to claim 25, further comprising a temperature detector disposed externally of said apparatus body, and being operably connected to said second fan such that said second fan is operated when a temperature outside of said apparatus body exceeds a set temperature.

29. The heating cooker according to claim 25, wherein said inlet of said fan opens upwardly at said upper part of said machinery compartment.

30. The heating cooker according to claim 25, wherein said machinery compartment has a top wall, and said first fan opens upwardly through said top wall of said machinery compartment.

31. A system of heating cookers including a first heating cooker located at an upper position and a second heating cooker located at lower position below said first heating cooker, said first heating cooker comprising:

an apparatus body having a food heating chamber and a machinery compartment provided therein;

a heating mechanism operably connected to said heating chamber and disposed in said machinery compartment;

a first fan operably connected to said heating chamber and said machinery compartment to cool said heating chamber and ventilate said machinery compartment;

a first intake opening for drawing air to said first fan;

a second intake opening provided on an underside of said apparatus body;

a second fan for drawing air through said second intake opening; and wherein said first fan is mounted on an upper part of said machinery compartment and said first intake openinq is located adjacent an inlet of said first fan such that air drawn through said first intake opening is drawn in directly by said first fan.

32. The system of heating cookers according to claim 31, further comprising a temperature detector disposed externally of said apparatus body, and being operably connected to said second fan such that said second fan is operated when a temperature outside of said apparatus body exceeds a set temperature.

33. The system of heating cookers according to claim 32, wherein said second fan of said first heating cooker is operated when said second heating cooker is operated.

34. The system of heating cookers according to claim 31, wherein said second fan of said first heating cooker is operated when said second heating cooker is operated.

35. The system of heating cookers according to claim 31, further comprising an extracting fan installed above said first heating cooker for exhausting vented air from said first heating cooker.

36. The system of heating cookers according to claim 31, wherein said inlet of said fan opens upwardly at said upper part of said machinery compartment.

37. The system of heating cookers according to claim 31, wherein said machinery compartment has a top wall, and said first fan opens upwardly through said top wall of said machinery compartment.

* * * * *